United States Patent [19]

Takao

[11] Patent Number: 4,708,109

[45] Date of Patent: Nov. 24, 1987

[54] APPARATUS FOR CONTROLLING AN IDLE SPEED OF AN INTERNAL COMBUSTION ENGINE

[75] Inventor: Mitsunori Takao, Kariya, Japan

[73] Assignee: Nippondenso Co., Ltd., Kariya, Japan

[21] Appl. No.: 883,308

[22] Filed: Jul. 8, 1986

[30] Foreign Application Priority Data

Jul. 9, 1985 [JP] Japan ..... 60-150905

[51] Int. Cl.[4] ..... F02D 41/16; F02M 3/07

[52] U.S. Cl. ..... 123/339

[58] Field of Search ..... 123/339, 440, 489

[56] References Cited

U.S. PATENT DOCUMENTS 4,508,075 4/1985 Takao et al. ..... 123/440 X

FOREIGN PATENT DOCUMENTS 113726 9/1979 Japan .
38786 9/1981 Japan .
138436 10/1981 Japan ..... 123/339
51148 3/1984 Japan ..... 123/339

*Primary Examiner*—Tony M. Argenbright
*Attorney, Agent, or Firm*—Cushman, Darby & Cushman

[57] ABSTRACT

An apparatus for controlling an idle speed of an internal combustion engine comprises an oxygen sensor disposed in a flow of an exhaust gas from the engine for detecting a concentration of residual oxygen in the exhaust gas, valves for varying an air-fuel ratio of a mixture to be supplied to the engine, a sensor for sensing a condition of the engine, an electronic control circuit for setting a desired air-fuel ratio and for feedback controlling the valves to make the air-fuel ratio closer to the desired air-fuel ratio on response to the signal from the oxygen sensor and for deciding whether or not the feedback control is to be executed, a sensor for detecting an idle condition of the engine, control valves for adjusting a flow rate of the mixture, and an actuator for driving the valves according to the electronic control circuit when the sensor detects the idle condition of the engine. According to the apparatus, when the feedback control is interrupted, the idle speed of the engine is lowered.

4 Claims, 11 Drawing Figures

APPARATUS FOR CONTROLLING AN IDLE SPEED OF AN INTERNAL COMBUSTION ENGINE

FIELD OF THE INVENTION AND RELATED ART STATEMENT

The present invention relates to an apparatus for controlling an idle speed of an internal combustion engine.

In general, such apparatus is so constructed that a flow rate of an air-fuel mixture to be supplied to the engine in an idle running state is adjusted to stabilize a combustion is stabilized in the engine as well as save a fuel consumption thereof.

Heretofore, it has been known as a method for controlling the idle speed to a desired one that a throttle valve has been previously provided with an initial opening degree (idle opening degree) on manufacturing the engine. It is also known to preliminarily provided the engine with a bypass passage having a predetermined opening area, which bypasses the throttle valve. It is further known feedback control the opening degree of the throttle valve or the opening area of the bypass passage in response to a detected engine speed.

In the case of the former methods, it is necessary to set the initial opening degree of the throttle valve or the opening area of the bypass passage higher, since the speeds of the engines are different from each other due to production errors and the dispersion in the characteristics in the individual engines. Engine is set to be the same with each other. Thus, in some engines the idle speed is necessarily increased to deteriorate the fuel consumption.

To the contrary to the above, in the feedback control as disclosed in Japanese Patent Unexamined Publication No. 54-113726, for example, the idle speed can be advantageously maintained at the aimed speed regardless of the production errors and the characteristic dispersion thereby insuring an improved fuel consumption.

Furthermore, an apparatus has been heretofore generally disclosed in Japanese Patent Examined Publication No. 56-38786 (U.S. Pat. No. 3,831,564), which carries out a feedback control on the basis of an output signal from an oxygen sensor mounted in an exhaust pipe of the internal combustion engine so as to control a flow rate of fuel supplied to the engine to maintain an air-fuel ratio of the mixture at the theoretical air-fuel ratio. The command signal generated in this feedback control corresponds to the output signal of the oxygen sensor and is a periodic signal as shown in FIG. 7. The frequency of the control signal is substantially proportional to the speed of the engine due to an influence of a delay in strokes of suction, compression, explosion and exhaust of the engine in case that a temperature of an atmosphere surrounding the oxygen sensor is constant. Thus, the frequency is reduced when the engine speed is low such as in the idle running, so that a period is prolonged and as a result, the amplitude of the control signal is enlarged. This means that the variation of air-fuel ratio modified in proportion to the control signal becomes large and variation of torque becomes large.

Since the amplitude of the control signal results in a deviation of an amount of a fuel supply, the air-fuel ratio is changed under the steady state such as in the idle running wherein the amount of drawn air is constant FIG. 8 shows the relationship between the air-fuel ratio and the torque generated in the engine. The inclination of the generated torque is steep in a region in which the air-fuel ratio is smaller than the theoretical air-fuel ratio. Therefore, in an internal combustion engine provided with such air-fuel ratio feedback control system using an oxygen sensor, in case the engine speed is lowered during idle running so as to improve the fuel consumption, the air-fuel ratio is changed as above-described. Accordingly, the generated torque is also changed and then the engine speed is fluctuated. Such fluctuation makes the driver unpleasant, so it is impossible to control the idle speed sufficiently low. Thus, the fuel consumption can not be fully saved.

OBJECT AND SUMMARY OF THE INVENTION

In view of the above, an object of the present invention is, therefore, to provide an apparatus for controlling an idle speed of an internal combustion engine which improve the fuel consumption of the engine during idle running, in which an air-fuel ratio feedback control system using an oxygen sensor is provided.

To this end, the present inventors payed attentions to the fact that the magnitude of the fluctuation of the engine speed when the feedback control system is conducted is reduced to a half or less than that when the feedback control system is not conducted. There is provided in accordance with the present invention an apparatus for controlling an idle speed of an internal combustion engine comprising an oxygen sensor disposed in a flow of an exhaust gas from the engine, the sensor outputting a signal corresponding to a concentration of residual oxygen in the exhaust gas, means for setting a desired air-fuel ratio, means for varying an air-fuel ratio of a mixture to be supplied to the engine, means for feedback controlling the varying means to make the air-fuel ratio closer to the desired air-fuel ratio in response to the signal from the oxygen sensor, means for sensing a condition of the engine and outputting a signal corresponding thereto means for deciding whether or not the feedback control means is to be executed in response to the signal from the sensing means; means for detecting an idle condition of the engine, means for adjusting a flow rate of the mixture, and means for driving the adjusting means according to a decision of the deciding means when the detecting means detects the idle condition of the engine.

The features and the advantages of the present invention will become more apparent from the following description of the preferred embodiment with referring to the accompanying drawings.

DETAILED DESCRIPTION OF THE PREFERRED EMBODIMENTS

Figure 1:
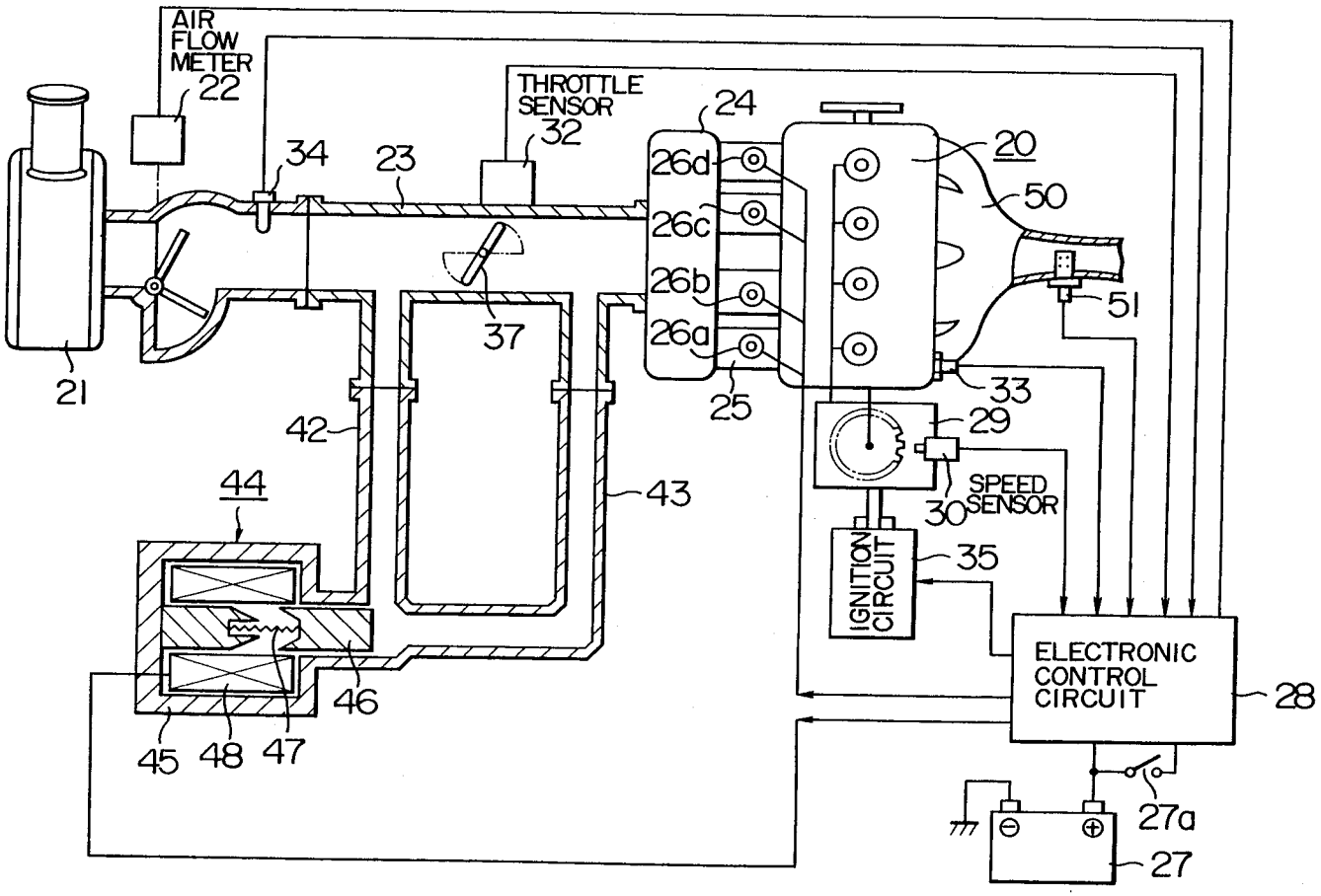
FIG. 1 is a schematic view showing a construction of one embodiment of the invention.

In FIG. 1, the reference numeral 20 designates a spark ignition type four-cylinder and four-cycle engine. An air is drawn into each cylinders through an air cleaner 21, an air flow meter 22, an intake pipe 23, a surge tank 24 and an intake manifold 25. Fuel is pumped out from a fuel tank (not shown) to fuel injection valves 26*a*, 26*b*, 26*c*, 26*d* and injected therethrough to the respective cylinders, which are provided in the manifold 25. The exhaust gas from the engine 20 is discharged outside through an exhaust pipe 50. An electronic control circuit 28 is actuated by an electric power from a battery 27 through a key switch 27*a*. The electronic control circuit 28 determines a running condition of the engine 20 on the basis of an engine speed detected by a speed sensor 30 provided within a distributor 29 and output signals from the air flow meter 22, a throttle sensor 32, a warming-up sensor 33, an intake air temperature sensor 34 and an oxygen sensor 51. The control circuit 23 calculates a desired flow rate of fuel to be injected into the cylinders and a desired idle speed in the idle running of the engine 20, and controls the above elements on the basis of the desired values. The air flow meter 22 is provided with a potentiometer rotated correspondingly to the intake air flow rate and outputs an analog signal corresponding thereto. The speed sensor 30 is disposed opposite a ring gear which rotates in synchronism with a crank shaft of the engine 20. The speed sensor 30 generates 24 pulse signals per one revolution of the crank shaft, i.e. per 720 degrees C A (crank angle). The throttle sensor 32 generates an analog signal corresponding to the opening degree of a throttle valve 37 while it outputs an ON-OFF signal from an idle switch which detects that the throttle valve 37 is substantially closed. The warming-up sensor 33 and the intake air temperature sensor 34 consist of thermal sensitive elements such as thermistors. The warming-up sensor 33 detects a temperature of an engine cooling water representing a temperature of the engine, while the intake air temperature sensor 34 detects a temperature of the intake air. The oxygen sensor 51 is mounted in the gathered position of the exhaust pipes 50 and generates a voltage signal corresponding to the residual oxygen concentration in the exhaust gas. The residual oxygen concentration varies in response to the air-fuel ratio of the mixture supplied to the engine 20. The oxygen sensor 51 generates a voltage signal of about 1 volt under a rich condition in which an air-fuel ratio of the mixture is lower than the theoretical air-fuel ratio, while it generates a voltage signal of about 0.2 volt under a lean condition in which an air-fuel ratio is higher than theoretical air-fuel ratio. The engine 20 is provided with a distributor 29 which supplies a high voltage signal generated in an ignition circuit 35 to each of four ignition plugs (not shown) to ignite the mixture in the respective cylinders, which are provided in the respective cylinders. An ignition timing and a duty time of ignition are controlled by the electronic circuit 28. The ignition circuit 35 is constructed by an ignitor and an ignition coil.

Air conduits 42, 43 are provided in the intake pipe 23 so as to bypass the throttle valve 37. The air conduits 42, 43 are connected to each other at a communication passage section through an air flow control valve 44 which is substantially linear solenoid valve. The valve 44 varies a cross-section area of the communication passage section depending upon a position of a plunger 46 movably disposed in a housing 45 of the valve 44. The valve 44 normally closes the communication passage section since a compression spring 47 urges the plunger 46 to close the area of the communication passage section. When an exciting coil 48 is energized, the plunger 46 is magnetically drawn to the exciting coil 48 to open the communication passage section. In other words, the flow rate of the bypassed air is controlled by continuously varying an exciting current supplied to the exciting coil 48. In this case, the exciting current to the exciting coil 48 is controlled by varying a duty ratio of a pulse width of the pulse signals applied to the exciting coil 48, i.e. by the so-called pulse width modulation (PWM) control.

The air flow control valve 44 is controlled by the electronic control circuit 28 in like manner as the fuel injection valves 26*a*–26*d*. A diaphragm type valve or a stepping motor driven valve may be used as the air flow control valve 44.

Figure 2:
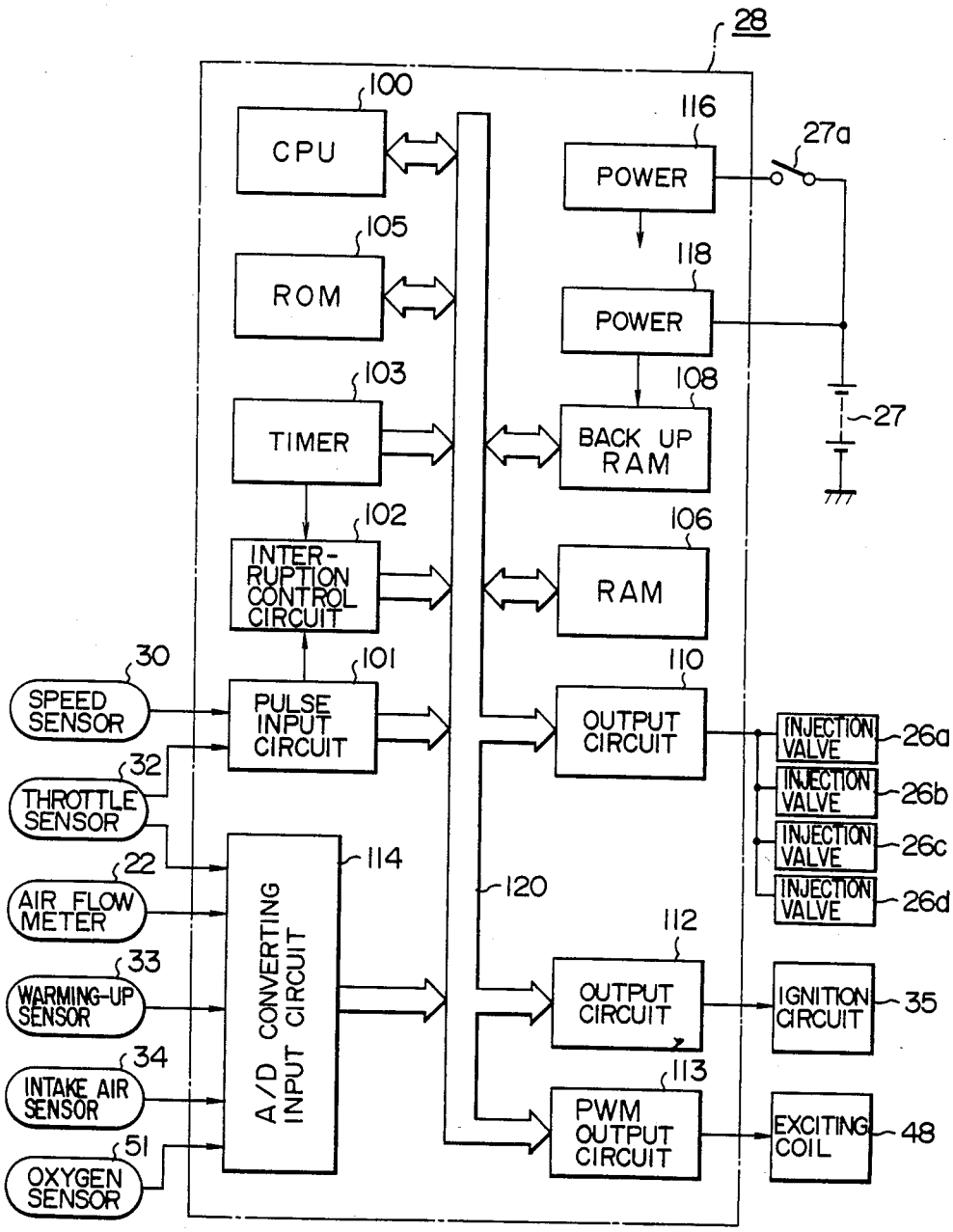
FIG. 2 is a block diagram of an electronic control circuit shown in FIG. 1.

The electronic control circuit 28 will be described hereinafter referring to FIG. 2. In the drawing, a reference numeral 100 designates a central processing unit (CPU) for setting the ignition timing and calculating an amount of fuel to be injected according to a stored program. A reference numeral 101 designates a pulse input circuit for receiving pulse signals from the speed sensor 30 as well as ON-OFF signals from the idle switch (not shown) in the throttle sensor 32. A reference numeral 102 designates an interruption control circuit for generating interruption signals at the predetermined crank angle according to the pulse signals from the pulse input circuit 101. A reference numeral 103 designates a timer. A reference numeral 105 designates a read only memory (ROM) for preliminarily storing the program and the data. A reference numeral 106 designating a random access memory (RAM) for temporarily storing the data. A reference numeral 108 designating a RAM having a back-up function of holding the data stored therein even after turning off the key switch 27*a*. A reference numeral 110 designates an output circuit for driving the fuel injection valves 26*a*–26*d*. A reference numeral 112 designates an output circuit for driving the ignition circuit 35 to control the ignition timing of the engine 20. A reference numeral 113 designates a PWM output circuit for outputting the duty controlled voltage signals to the exciting coil 48 of the air flow control valve 44. A reference numeral 114 designates an A/D converting input circuit for converting the analog signals from the air flow meter 22, the warming-up sensor 33, the throttle sensor 32, the intake air temperature sensor 34 and the oxygen sensor 51 to 8 bits digital ones. A reference numeral 115 designates an electric power source circuit for regulating an electric power from the battery 27 through the key switch 27*a* and supplying a constant voltage to the electronic control circuit 28. A reference numeral 118 designates another electric power source circuit connected to the battery 27 without through the key switch 27*a* for supplying electric power to the back-up RAM 108. A reference numeral 120 designates a data bus connecting the above described circuits to each other. The output circuit 110 is provided with a counter (not shown) which counts down at a predetermined timing when the fuel injection time $\tau$ is set by the CPU 100. The output circuit 110 outputs a command to the respective fuel injection valves to open them until zero is counted so as to control the amount of the fuel to be injected.

Figure 3:
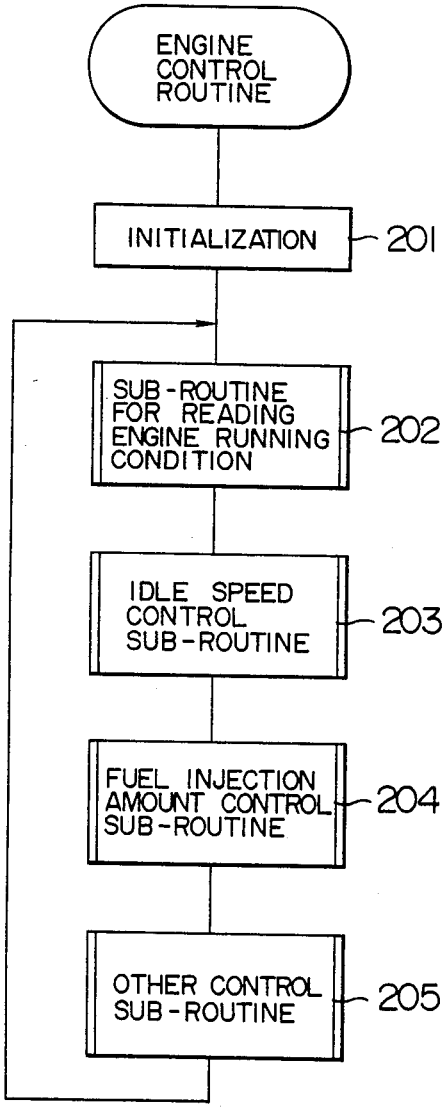
FIG. 3 is a flow chart showing a basic engine control routine in the electronic control circuit shown in FIG. 2.

In the above described embodiment, a basic engine controlling routine shown in FIG. 3 is carried out.

The operations of the electronic control circuit 28 will be described hereinafter referring to FIG. 3. The electronic control circuit 28 starts when the key switch 27*a* is turned on. At first, in step 201 internal registers are cleared and parameters are initialized. Operations of steps 202–205 are repeated. Here, the steps 202 is a sub-routine for reading-in the condition of the operation of the engine 20, i.e., for reading in the amount Q of the intake air, the engine speed N, the intake air temperature THA, the throttle opening degree $\theta$, the warming-up temperature THW of the engine, and the air-fuel ratio A/F of the mixture, which are detected by the air flow meter 22, the speed sensor 30, the intake air temperature sensor 34, the throttle sensor 32, the warming-up sensor 33 and the oxygen sensor 51, respectively. Such read values are used at any time required in other sub-routines such as idle speed control sub-routine (step 203), fuel injection amount control sub-routine (step 204) and other control sub-routine (step 205).

The step 203 is the idle speed control sub-routine. In this step, engine speed N is feedback controlled to the desired speed as set in response to the engine operation condition only during the idle running where the throttle valve is fully closed. The detail of the above sub-routine will be described later.

Figure 4:
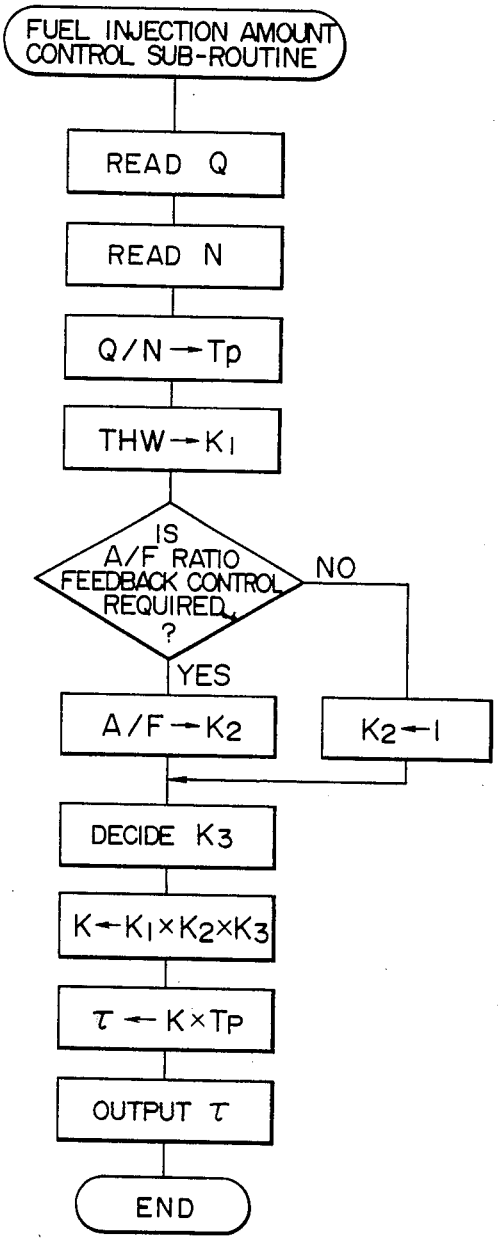
FIG. 4 is a flow chart showing a sub-routine of fuel injection shown in FIG. 3.
Figure 7:
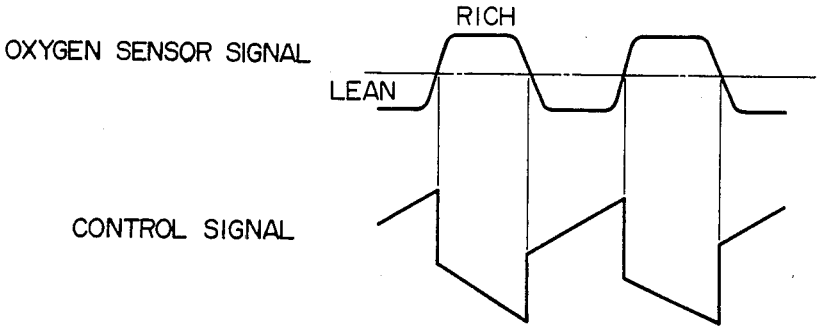
FIG. 7 is a diagram showing wave forms of a signal from an oxygen sensor and a control signal corresponding thereto.

The step 204 is a fuel injection amount control sub-routine, in which the desired fuel injection amount is calculated according to the warming-up condition THW of the engine 20 and the air-fuel ratio A/F, etc. by compensating for the basic fuel injection amount calculated on the basis of the load of the engine (Q/N). This routine is a routine as shown in FIG. 4, for example, which calculates the basic amount of the injected fuel $T_P$ on the basis of the load Q/N. A first sub compensator coefficient K1 is determined in accordance with the warming-up condition THW. Then, it is determined whether or not the air-fuel ratio is necessitated to be feedback controlled to the theoretical air-fuel ratio in response to the signal from the oxygen sensor as shown in FIG. 7, depending upon the engine operation condition, for example, whether or not the engine is before or after a completion of the warming-up, at a steady state or in a transition state, or in an idle running or not. In case the feedback control to the air-fuel ratio is required, a second sub compensator coefficient K2 is determined from the control signal in the air-fuel feedback control, which corresponds to the signal from the oxygen sensor as shown in FIG. 7. In other words, the second sub compensator coefficient K2 is obtained corresponding to the air-fuel ratio A/F of the mixture corresponding to the output of the oxygen sensor 51. When the air-fuel feedback control is not carried out, the second sub compensator coefficient K2 is set to 1. That is, the compensation against the air-fuel ratio A/F is not carried out. Thereafter, a third sub compensator coefficient K3 is determined in response to the outputs from other sensors so as to calculate a compensator coefficient K (=K133 K233 K3) with respect to the basis fuel injection amount $T_P$. The basic fuel injection amount $T_P$ is compensated by the compensator coefficient K to obtain a desired fuel injection amount $\tau$. A command signal is supplied to the output circuit 110 so as to make the fuel injection valves inject the fuel of an amount $\tau$. With this sub-routine, therefore, the fuel injection amount $\tau$ from the fuel injection valves 26*a*–26*d* is so feedback controlled that the air-fuel ratio is closed to the theoretical air-fuel ratio when the air-fuel feedback control is carried out. Accordingly, the fuel injection amount $\tau$ is varied correspondingly to the control signal shown in FIG. 7 each time of processing this sub-routine.

Figure 5:
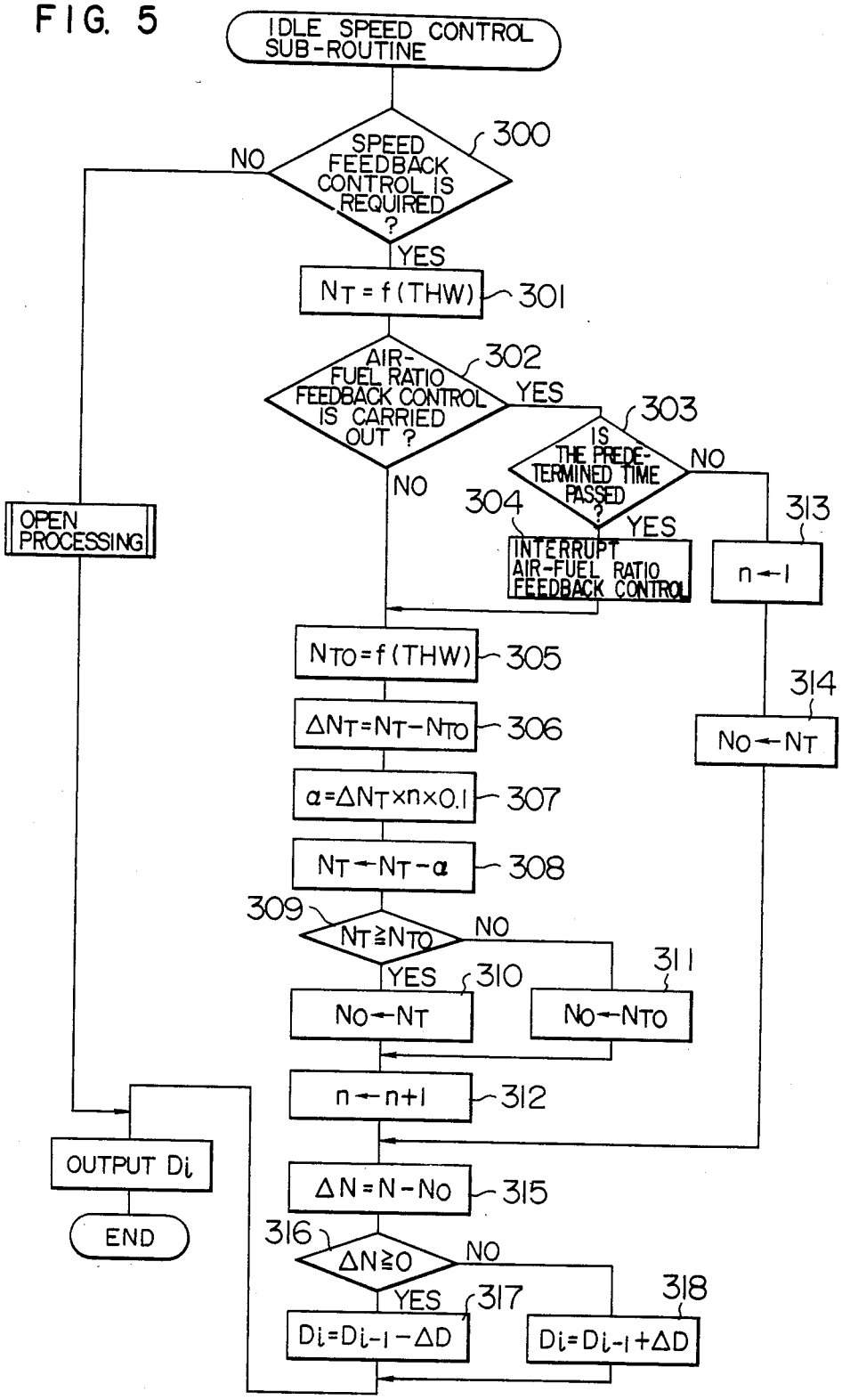
FIG. 5 is a flow chart showing a sub-routine of the idle speed shown in FIG. 3.

Now, the idle speed control routine of the step 203 will be described with reference to FIG. 5.

First, it is detected in the step 300 whether or not the running condition of the engine is in the idling state as set by the idle switch in the throttle sensor 32 and the engine speed N. When the idling condition is detected, the process proceeds to the step 301, as assumed that the feedback control of the engine speed is desired. In the step 301, the desired speed $N_T$ for carrying out the feedback control to the air-fuel ratio is obtained from the map shown in FIG. 9 in response to the warming-up condition THW of the engine. In the step 302, it is decided whether or not the feedback control of the air-fuel ratio is carried out. When the feedback control is carried out, the process proceeds to the step 303, while when the feedback control is not carried out, the process proceeds to the step 305. In the step 303, it is decided whether or not a predetermined time elapses after the idling condition is detected. When it is decided that the predetermined time elapses, it is made in the step 304 that the feedback control to the air-fuel ratio is interrupted, and the process proceeds to the step 305. In the step 303, the feedback control to the engine speed is carried out until the predetermined time elapses while the feedback control to the air-fuel ratio is also carried out, thereby carrying out a well-known learning control (not shown) related to the feedback control to the air-fuel ratio.

Figure 9:
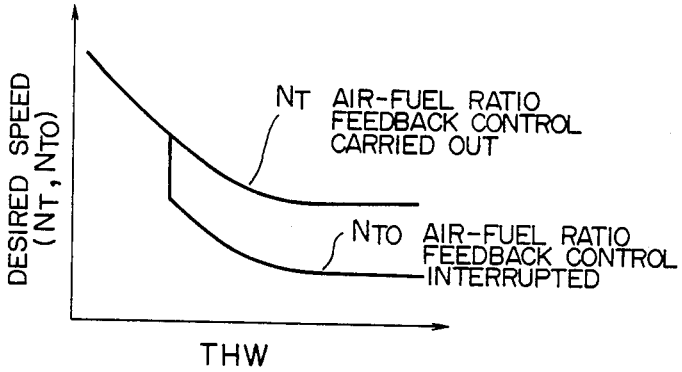
FIG. 9 is a diagram showing a desired speed $N_T$ when the feedback control system is conducted and a desired speed $N_{TO}$ when the feedback control system is not conducted both speeds being set in response to a warming-up condition of the engine, respectively.

In the step 305, the desired speed $N_{TO}$ for the case the feedback control of air-fuel ratio is not carried out is determined from the map shown in FIG. 9 depending upon the warming-up condition THW. As is understood from FIG. 9, the desired speed $N_{TO}$ is set lower than the desired speed $N_T$. The steps 306–311 are proceeded to gradually vary the engine speed from the desired speed $N_T$ to the desired speed $N_{TO}$. First, a difference $\Delta N_T$ between $N_T$ and $N_{TO}$ is determined in the step 306 and a value $\alpha$ to be subtracted is determined in the step 307 by multiplying the difference $\Delta N_T$ by $n \times 0.1$ where the n is the number of times of the conduction of the step 307 counted by a counter after the feedback control to the air-fuel ratio is interrupted in the step 304. In the step 308, the value $\alpha$ is subtracted from the desired $N_T$ and the desired speed $N_T$ is renewed. In the step 309, the renewed speed $N_T$ is compared with the desired speed $N_{TO}$. If $N_T \geqq N_{TO}$, the process proceeds to the step 310 where the value $N_T$ renewed in the step 308 is substituted for the desired speed No which is used in the succeeding steps. If $N_T < N_{TO}$, the process proceeds to the step 311 where the value $N_{TO}$ is substituted for the desired speed No. In the step 312, the counter counts up. Thus, the desired speed No is between the desired speeds $N_T$ and $N_{TO}$ after the feedback control to the air-fuel ratio is interrupted and before the counter counts a predetermined number. As the count n increases, the desired speed No approaches the desired speed $N_{TO}$.

The desired speed No is rendered to become the desired speed $N_{TO}$ when the count n becomes equal to or greater than the predetermined number.

When it is decided in the step 303 that the predetermined time does not elapse, the process preceeds to the step 313 and the counter n is reset to 1. In the step 314, the desired speed $N_T$ is substituted for the desired speed No, which is obtained in the step 301 for the condition wherein the feedback control to the air-fuel ratio is carried out.

In the step 315, a difference ΔN between the desired speed No and the actual speed N of the engine is calculated. In the steps 316, 317 and 318, a controlled variable (duty ratio) Di is set corresponding to whether the calculated difference ΔN is positive or negative. In other words, when $\Delta N \geqq 0$, the controlled variable Di is calculated by subtracting the increased or decreased value ΔD from a controlled variable $Di_{-1}$ set in the last idle speed control sub-routine (step 317). To the contrary, if $\Delta N < 0$, the controlled variable Di is calculated by adding the increased or decreased value ΔD to the previous controlled variable $Di_{-1}$.

The controlled variable Di set as described above is output at the step 320. The PWM output circuit 113 generates an exciting current having a pulse width of a duty ratio corresponding to the controlled variable Di and supplies the exciting current to the exciting coil 48 of the air control valve 44.

Figure 10:
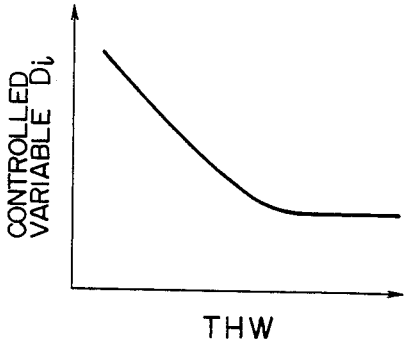
FIG. 10 is a diagram showing the controlled variable Di corresponding to the warming-up condition of the engine, which is used in an open processing of the subroutine of the idle speed shown in FIG. 5.
Figure 11:
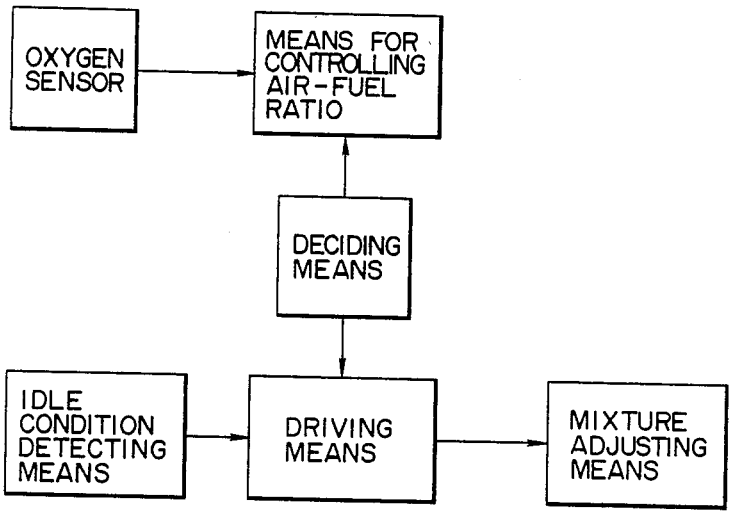
FIG. 11 is a block diagram showing components of the present invention.

When it is decided in the step 300 that the engine is not in the idle running and the feedback control to the engine speed is not required, the process proceeds to the step 319 where open processing is conducted. Namely, a controlled variable Di is set by determining from the map shown in FIG. 10 in response to the condition of warming-up of the engine 20.

Figure 6:
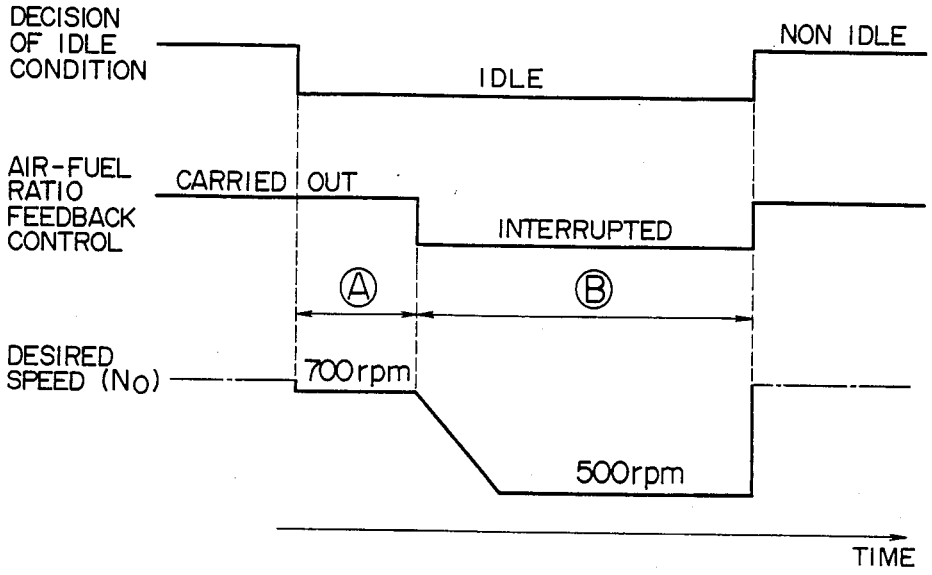
FIG. 6 is a time chart corresponding to the sub-routine shown in FIG. 5.
Figure 8:
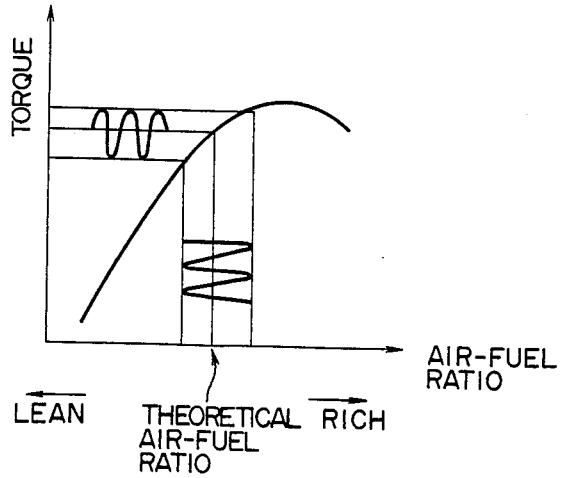
FIG. 8 is a diagram showing a relationship between an engine torque and an air-fuel ratio of mixture.

Since the idle speed is controlled according to the idle speed control sub-routine, unpleasant feeling of the driver can be reduced by setting the desired speed to a value by which the variation in the torque (FIG. 8) due to the periodic variation in the air-fuel ratio will not influence substantially on the variation in the engine speed under the condition of carrying out the feedback control to the air-fuel ratio (region A) as shown in FIG. 6, while unpleasant feeling of the driver is also reduced by interrupting the feedback control to the air-fuel ratio after the lapse of the predetermined time, so that under the condition of not carrying out the feedback control to the air-fuel ratio (region B), the desired speed can be set to a value lower than that set when the feedback control to the air-fuel ratio is carried out, because no compensation for the amount of the injected fuel by the control signal shown in FIG. 7 is effected thereby resulting in no periodic variation in the amount of the injected fuel corresponding to the above described control signal to suppress the variation in the speed, which makes it possible to improve the consumption of the fuel. In the above described sub-routine, the desired speed is gradually varied from the desired speed $N_T$ to the desired speed $N_{TO}$ when a transition is made from the condition of carrying out the above feedback control to the condition of not carrying out the above feedback control. However, it can be also possible to vary the desired speed immediately and discontinuously. It is preferrable, however, to vary the desired speed gradually, since such gradual variation of the desired speed can suppress the reduction of the actual speed of the engine.

When a transition is made from the condition of not carrying out the feedback control to the air-fuel ratio to the running condition of the engine, the feedback control to the air-fuel ratio is again carried out immediately or with a delay of a predetermined time.

The above described embodiment has been described as being a control apparatus having the idle speed feedback control. However, instead of the above described feedback control, it may be possible for a control apparatus to open the air conduits 42, 43 bypassing the throttle valve 37 under the condition of carrying out the feedback control to the air-fuel ratio, while to close the conduits under the condition of not carrying out the feedback control to the air-fuel ratio, such as in the case of ON/OFF control of the vacuum switching valve, for example.

In the above described embodiment, the apparatus has the construction in which the air conduits 42, 43 are provided for bypassing the throttle valve 37 and the amount of the intake air flowing therethrough is controlled. However, the throttle valve 37 can be controlled depending upon the condition whether or not the feedback control to the air-fuel ratio is carried out.

The above described feedback control to the air-fuel ratio has been described as being carried out with respect to the theoretical air-fuel ratio. However, it is possible to carry out the feedback control to the air-fuel ratio by using the oxygen sensor 51 outputting a linear signal to the air-fuel ratio for feedback controlling the air-fuel ratio to a predetermined air-fuel ratio.

According to the present invention as described above, the engine speed is controlled under the condition of carrying out the feedback control to the air-fuel ratio by controlling the supply of the mixture to the engine by adjusting means for adjusting the flow rate or the amount of the mixture supplied to the engine to the extent that the variation in the speed during the idle running will not give unpleasant feeling to the driver, while, under the condition of not carrying out the feedback control to the air-fuel ratio, it is made possible to adjust the supply of the mixture so as to make the engine speed lower than that under the condition given when the feedback control to the air-fuel ratio is carried out thereby permitting the unpleasant feeling to the driver to be reduced, because there is no more variation in the air-fuel ratio which is caused by the output signal of the oxygen sensor under the condition of carrying out the feedback control to the air-fuel ratio so that the range of variation in the speed is suppressed to a half or lesser. Therefore, superior effectiveness is obtained in improving the consumption of the fuel while unpleasant feeling given to the driver due to the variation in the speed during the idle running of the engine is reduced to the minimum.

What is claimed is:

1. An apparatus for controlling an idle speed of an internal combustion engine comprising:

an oxygen sensor disposed in a flow of an exhaust gas from the engine, said sensor outputting a signal corresponding to a concentration of residual oxygen in the exhaust gas;

means for varying an air-fuel ratio of a mixture to be supplied to the engine;

means for feedback controlling said varying means to make the air-fuel ratio closer to a desired air-fuel ratio in response to the signal from said oxygen sensor;

means for sensing a condition of the engine and outputting a signal corresponding thereto;

means for deciding whether or not said feedback control means is to be executed in response to the signal from said sensing means;

means for detecting an idle condition of the engine;

means for adjusting a flow rate of said mixture;

means for driving said adjusting means according to a decision of said deciding means when said detecting means detects the idle condition of the engine, said driving means including means for detecting the speed of the engine, means for setting a desired speed under the idle running of the engine in response to said detecting means, means for calculating the speed difference between the engine speed detected by said speed detecting means and the desired speed set by said desired speed setting means when the idle running condition is detected by said idle condition detecting means, means for setting a controlled variable in response to the speed difference obtained by said calculating means, means for controlling a manipulated variable of said adjusting means in response to the controlled variable set by said controlled variable setting means; and wherein the desired speed obtained by said desired speed setting means under a condition where said feedback control means is not carried out is set lower than that obtained under a condition where said feedback control means is carried out.

2. An apparatus for controlling an idle speed of an internal combustion engine comprising:

means for sensing oxygen content in an exhaust gas from said engine;

means for feedback controlling air-fuel ratio of mixture to be supplied to said engine in response to the sensed oxygen content;

means for sensing an idling condition of said engine where a throttle valve of said engine is closed;

means for sensing a rotational speed of said engine;

means for comparing the sensed rotational speed with a desired first idle speed when the idling condition is sensed by said idling condition sensing means so that the rotational speed of said engine is feedback controlled to the desired idle speed during the idling condition;

means for stopping the air-fuel ratio feedback control during the idling condition; and means for lowering the desired first idle speed to a second idle speed when the air-fuel ratio feedback control is stopped.

3. An apparatus according to claim 2 further comprising:

means for changing the desired idle speed from the first idle speed to the second idle speed gradually with respect to time.

4. An apparatus according to claim 3 further comprising:

means for delaying stopping the air-fuel ratio feedback control for a predetermined interval from the time the idling condition is sensed.

* * * * *